US007128580B2

(12) United States Patent
Liao et al.

(10) Patent No.: US 7,128,580 B2
(45) Date of Patent: Oct. 31, 2006

(54) SOCKET CONNECTOR WITH SUPPORTING HOUSING PROTRUSIONS

(75) Inventors: Fang-Jwu Liao, Tu-Chun (TW); Ming-Lun Szu, Tu-Chun (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/175,071

(22) Filed: Jul. 5, 2005

(65) Prior Publication Data

US 2005/0245108 A1 Nov. 3, 2005

Related U.S. Application Data

(63) Continuation-in-part of application No. 10/894,735, filed on Jul. 19, 2004, and a continuation-in-part of application No. 10/822,099, filed on Apr. 9, 2004, now Pat. No. 6,921,271.

(30) Foreign Application Priority Data

Nov. 19, 2004 (TW) ..... 93218542 U

(51) Int. Cl.
*H01R 12/00* (2006.01)

(52) U.S. Cl. ..... 439/71; 439/66

(58) Field of Classification Search ..... 439/68–71, 439/948, 266, 330, 342, 525, 66, 885, 526, 439/527, 263, 64, 259, 331, 264–265
See application file for complete search history.

(56) References Cited

U.S. PATENT DOCUMENTS 3,951,495 A 4/1976 Donaher et al.
4,616,895 A 10/1986 Yoshizaki et al.
5,066,245 A * 11/1991 Walker ..... 439/526
6,196,852 B1 3/2001 Neumann et al.
6,447,318 B1 * 9/2002 Okamoto ..... 439/266
6,585,527 B1 7/2003 Koopman et al.
6,604,950 B1 8/2003 Maldonado et al.
6,695,625 B1 2/2004 Ma et al.
6,705,876 B1 3/2004 Eldridge
6,805,561 B1 10/2004 Walkup et al.
6,824,395 B1 11/2004 Uratsuji
6,921,271 B1 * 7/2005 Liao et al. ..... 439/66
7,008,237 B1 * 3/2006 Ma et al. ..... 439/66
7,014,477 B1 * 3/2006 Tsai ..... 439/71
2004/0203264 A1 10/2004 Liao et al.
2005/0014398 A1 1/2005 Liao et al.

* cited by examiner

*Primary Examiner*—Truc T. Nguyen
*Assistant Examiner*—Edwin A. Leon
(74) *Attorney, Agent, or Firm*—Wei Te Chung

(57) ABSTRACT

A socket connector (1) includes a dielectric housing (11) and a number of contacts (12) received in the housing. The housing defines top and bottom surfaces (111, 112) and a number of passageways (113) between the top and bottom surfaces. Each contact has a retention body (121) secured in a corresponding passageway and a contact portion extending beyond the top surface a first vertical distance for engaging with a corresponding pad (21) of an IC package (2). The body has an end projects beyond the top surface a second vertical distance. Protrusions (115) extend upwardly from the top surface toward the IC package, for supporting the IC package. Each protrusion projects the top surface a vertical height shorter than said first vertical distance but larger than said second distance. Thereby the pad can be prevented from electrically engaging the body of an adjacent contact when the IC package is pressed to mate with the connector. Thus, reliable electrically connecting between the connector and the IC package is secured.

22 Claims, 9 Drawing Sheets

9

SOCKET CONNECTOR WITH SUPPORTING HOUSING PROTRUSIONS

CROSS-REFERENCE

This is a continuation-in-part application of the copending application with a Ser. No. 10/894,735 filed Jul. 19, 2004 and a continuation-in-part application of a application with a Ser. No. 10/822,099 filed Apr. 9, 2004 now U.S. Pat. No. 6,921,271.

BACKGROUND OF THE INVENTION

1. Field of the Invention

The present invention relates to the art of electrical connectors, and more particularly to a socket connector for electrically bridging two electrical interfaces such as an integrated circuit (IC) package and a printed circuit board (PCB).

2. Background of the Invention

Socket connectors are widely used to electrically interconnect two electrical interfaces such as an electrical substrate, e.g. a PCB and an integrated circuit (IC) package, e.g. a central processing unit (CPU).

FIGS. 8 and 9 show a typical socket connector 9 for electrically bridge a PCB 7 and an IC package 8. The connector 9 includes a dielectric base 91 and terminals 92 planted in corresponding passageways 911 of the base 91. Each terminal 92 has a retention portion 923 and first and second resilient arms 921, 922 joint two opposite sides of the retention portion 923. The first arm 921 extends outside an upper surface 912 of the base 91 and is compressed to engage a corresponding pad 80 of the IC package 8. The second arm 922 extends beyond a lower surface 913 of the base 91, and is pressed to mate with a corresponding pad 71 of the PCB 7.

Before insertion of the terminal 92 into the base 91, one end of the retention portion 923 of the terminal 92 is attached to a contact strip (not shown). After said insertion, the terminal 92 is cut off from the contact strip, the attached end (not numbered) of the retention portion 923 exposing outside the passageway 911. A pressing tool (not shown) is applied to push the attached end of the retention portion 923, thereby to queen the retention portion 923 of the terminal 92 into the passageway 91.

However, in most cases, after being pressed or pushed, the attached end of the terminal 92 may still projects beyond the upper surface 911 from the passageway 911 or at most flushes with the upper surface 911. Consequently, after the IC package is pressed to mate with the socket connector, the pad 81 of the IC package 8 is prone to electrically touch with the attached end of an adjacent terminal 92, specifically when the pad 81 has a relatively larger bottom mating face to fully engage with the first arm 921. If this happens, a short circuit occurs between the two adjacent terminals 92. This can effect, or even destroy effective electrical connecting performance of the socket connector 9.

What is needed, thereby, is a new socket connector that can secure reliable electrical interconnecting.

SUMMARY OF THE INVENTION

A socket connector according to a preferred embodiment may include a housing and a plurality of contacts secured in the housing. The housing defines top and bottom surfaces, and an array of passageways between the top and bottom surfaces for receiving the contacts. The contacts each are configured with a retention body secured in a corresponding passage and an upper spring arm extending from the body. A contact portion is formed at a topmost of the upper arm, extending outside the top surface a first vertical distance, for engaging with a corresponding pad of a mating electrical device. The retention body has an end projecting from the passageway beyond the top surface a second vertical distance in a thickness direction of the housing.

A plurality of supporting protrusions projects upwardly from the top surface toward the electrical device, for supporting the electrical device thereon. Each protrusion has a uniform vertical height h1 relative to the top surface in the thickness direction of the housing, the height h1 being shorter than said first vertical distance but higher than said second distance. Accordingly, when the mating electrical device is compressed to establish electrical engagement of the pads thereof with the contacts portion, the pads can be prevented from electrically touching with the retention bodies of adjacent contacts. As a result, reliability of electrical connecting between the socket connector and the mating electrical device can be assured.

DETAILED DESCRIPTION OF THE PREFERRED EMBODIMENT OF THE INVENTION

Figure 1:
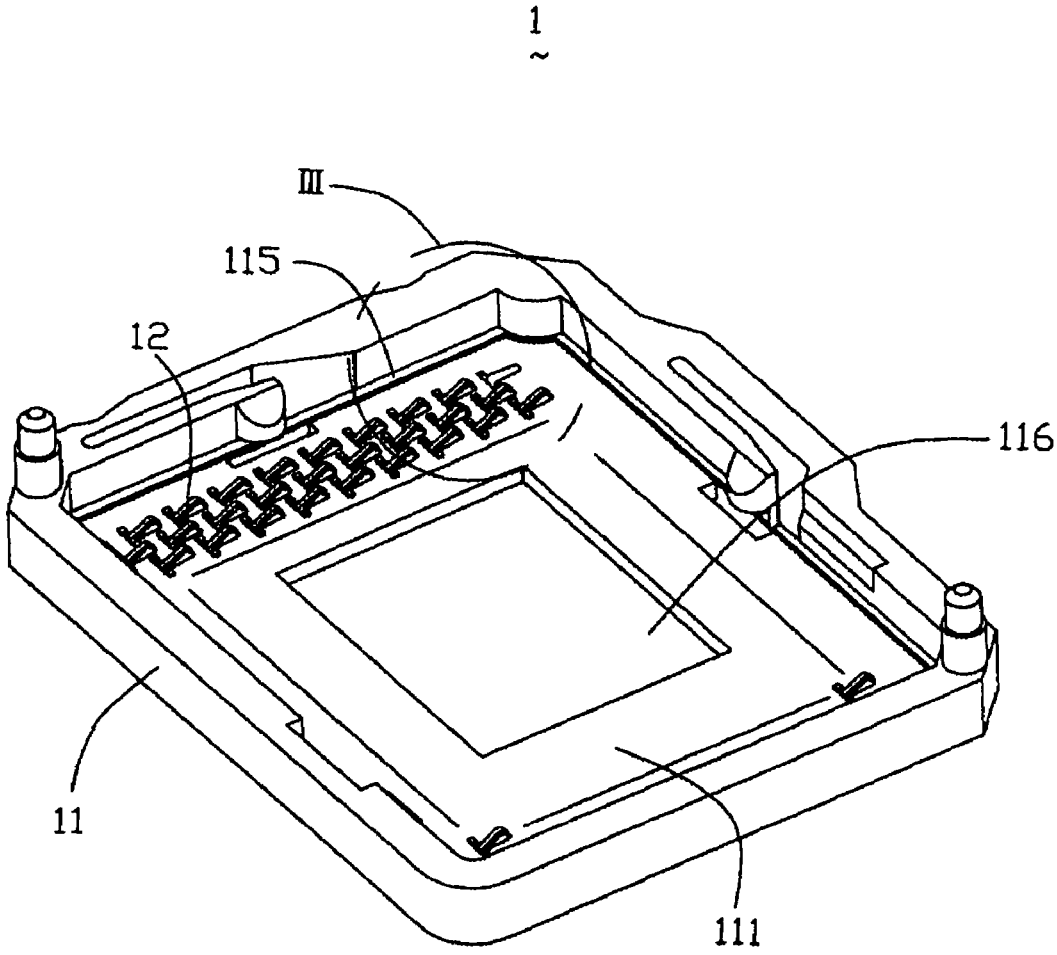
FIG. 1 is an isometric view of a socket connector according to one preferred embodiment of the present invention, showing contacts received in corresponding passageways defined in a housing of the socket connector respectively.

Referring to FIG. 1, a socket connector 1 according to a preferred embodiment of the invention is shown. The socket connector 1 is mainly used to electrically connect two electrical interfaces, such as an IC package 2 and a PCB 3 (referring to FIG. 5), but not limited thereto. The socket connector may, of course, be applied in other environments such as to electrically interconnecting two PCBs and so on. The socket connector 1 includes a generally rectangular housing 11 and a plurality of contacts 12 received in the housing 11.

The housing 11 is formed by molding with dielectric material such as plastic or the like. The housing 11 is configured with a base wall (not numbered) and four side walls (not numbered) extending upwardly from peripheral edges of the base wall. A receiving space (not numbered) is cooperatively defined by the side walls and the base wall, for accommodating the IC package 2 therein.

Figure 4:
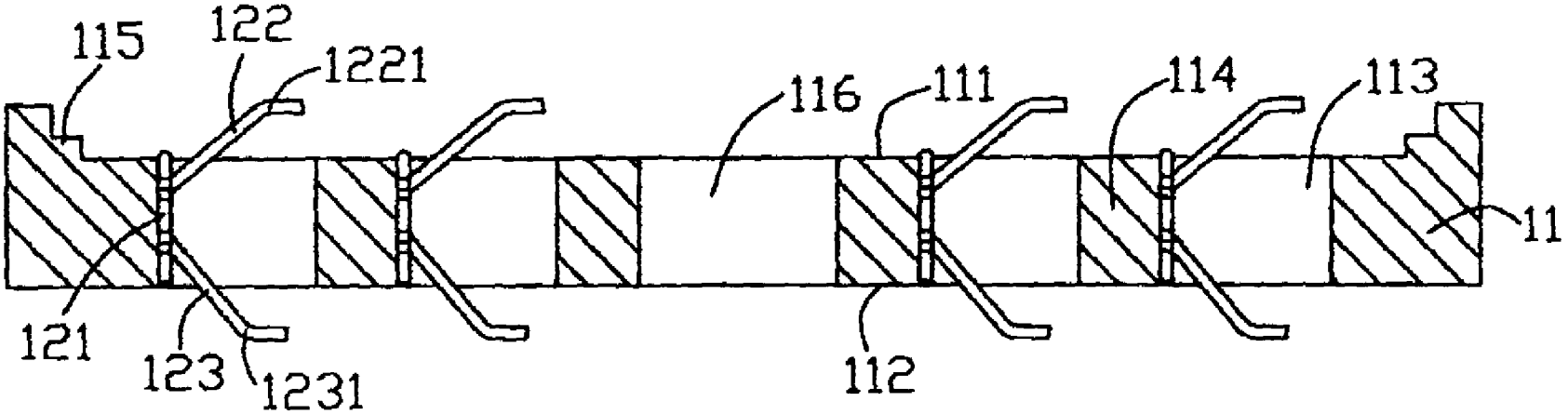
FIG. 4 is a cross sectional view of FIG. 1.

Referring also to FIG. 4, a top surface 111 is formed on a top of the base wall, for supporting the IC package 2 thereon. An opposite bottom surface 112 is formed on of the base wall, for being mounted on the PCB 3. A plurality of passageways 113 is defined in the base wall, regularly arranged in a generally rectangular array. Each passageway 113 extends from the top surface 111 to the bottom surface 112, for receiving a corresponding terminal 12 therein. The passageway 113 has a substantially T-shaped configuration, and includes a securing section 113A and a receiving section 113B vertical to and in communication with the securing section 113A. A spacer 114 is formed between every two adjacent passageways 113. The base wall also defines a square central hole 116.

Figure 3:
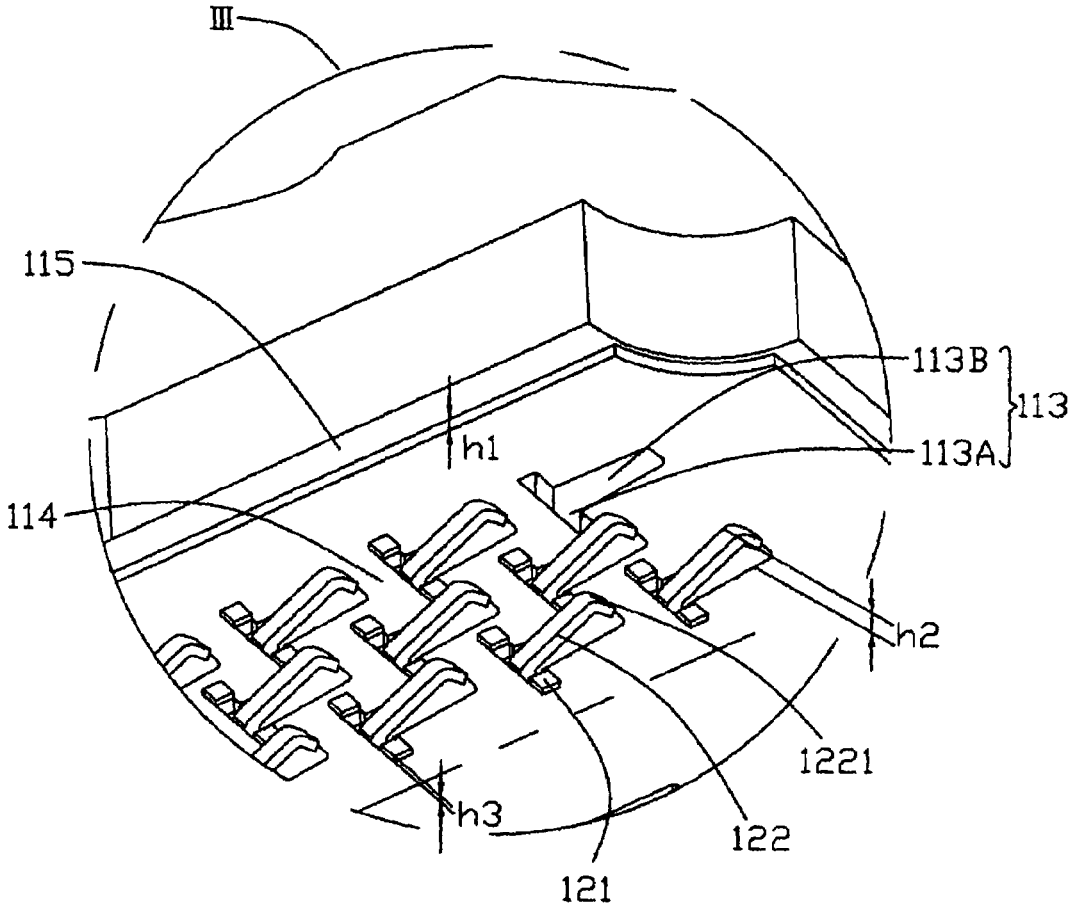
FIG. 3 is an enlarged view of a circled portion III of FIG. 1.

Referring best to FIG. 3, supporting protrusions 115 extend integrally upwardly from periphery of the top surface 111 toward the IC package 2, at joint of the top surface 111 and the side walls. The protrusions 115 are mainly adapted to uphold the IC package 2 thereon when the IC package 2 is pressed to mate with the socket connector 1. The protrusions 115 each have a uniform vertical height h1 relative to the top surface 111, in a thickness direction of the base wall.

Figure 2:
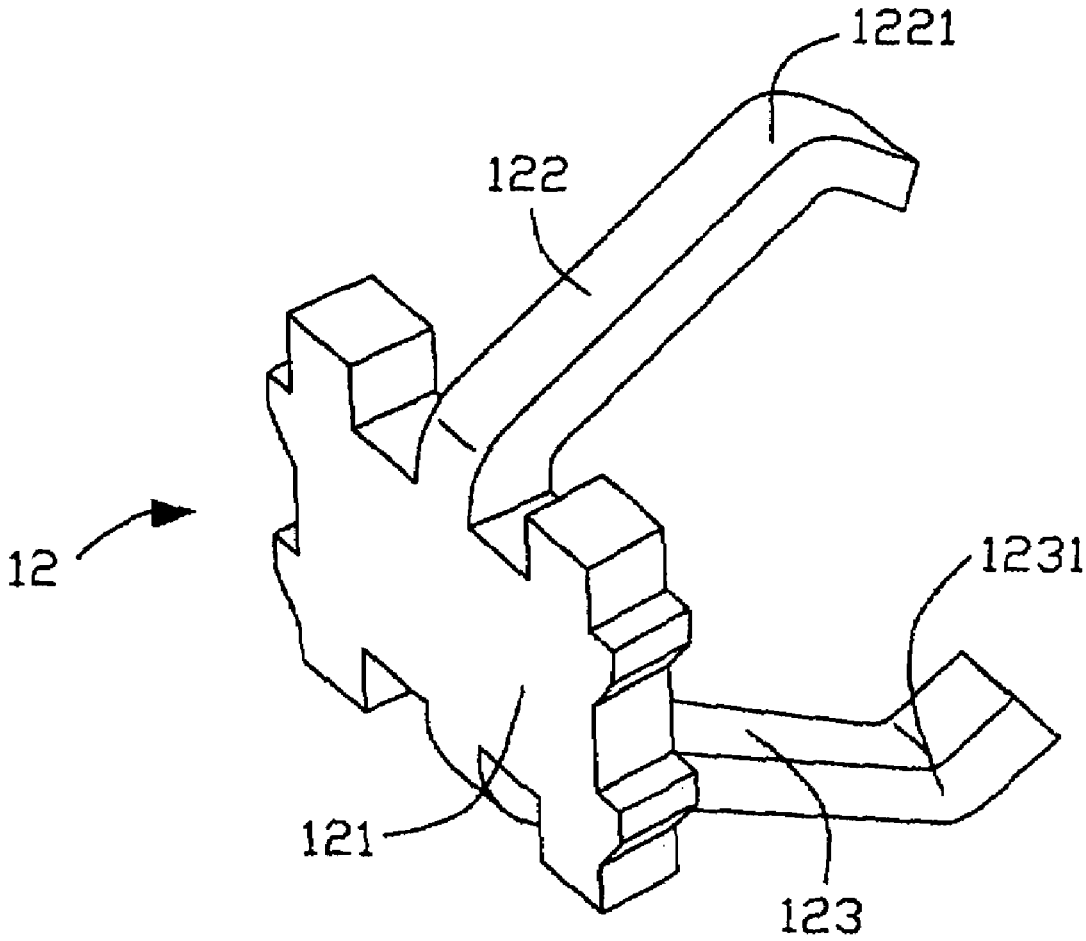
FIG. 2 is an enlarged, isometric view of one contact of FIG. 1.

Best referring to FIG. 2, the contacts 12 are formed from conductive material by known stamping processes. Each of the contacts 12 may include a generally rectangular retention body 121 and cantilever-shaped upper and lower spring arms 122, 123. A plurality of barbs (not numbered) is formed on opposite lateral sites of the body 121, for engagingly intervening inner sides of the securing section 113A of a corresponding passageway 113. The upper spring arm 122 extends upwardly and slantwise from a middle of a top side of the body 121. The lower spring arm 122 extends downwardly and slantwise from a middle of a bottom side of the body 121.

Referring also to FIG. 4, an upper contact portion 1221 is formed at a topmost of the upper spring arm 122, for mechanically and electrically engaging a corresponding conductive pad 21 of the IC package 2. A lower contact portion 1231 is provided at a bottommost of the lower spring arm 123, for mechanically and electrically engaging a corresponding pad 31 of the PCB 3. The upper and lower spring arms 122, 123 are symmetrically orientated each other with respect to the body 121, and arranged at one side of the body 121. When the contact 12 is inserted into the passageway 113, the upper contact portion 1221 project above the top surface 111 a first vertical distance h2 higher than the height h1 of the protrusions 115 relative to the top surface 111. An upper end of the retention body 121 projects beyond the top surface 111 a second vertical distance h3 shorter than the height h1 of the protrusions 115.

Figure 5:
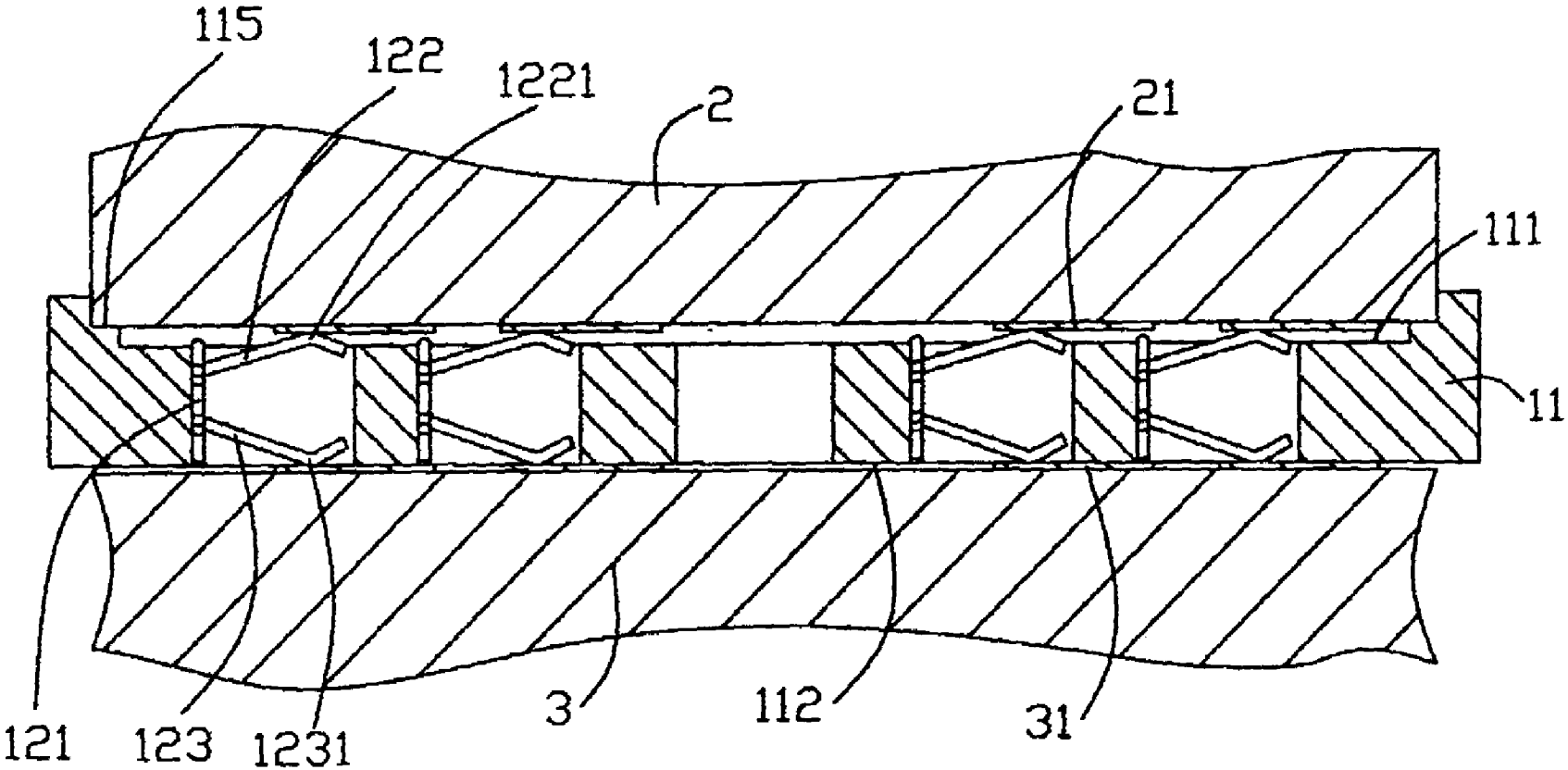
FIG. 5 is a cross sectional view of the socket connector of FIG. 1, together with an IC package having pads electrical mating with corresponding contacts and a PCB having pads electrically touching with said contacts.

Referring to FIG. 5, in use, the socket connector 1 is sandwiched between the IC package 2 and the PCB 3. Exterior force is applied to press the IC package 2 and the PCB 3 to close toward each other until the IC package 2 stand on the protrusions 115, compressing the upper and lower contact portions 1221, 1231 electrically engaging the pads 21, 31, respectively. During said pressing, the pad 21 of the IC package 2 urges the corresponding upper contact portion 1221, thereby to force the upper spring arm 122 to resiliently deform and intrude into the receiving section 113B of the passageway 113. Reliability of mechanical and electrical engagement between the pad 21 and the upper contact portion 1221 is established. At the same time, the pad 31 of the PCB 3 quell the lower contact portion 1231, thereby to force the lower spring arm 123 to resiliently deform and enter into the receiving section 113B of the passageway 113. Thus, reliable engagement between the socket connector 1 and the PCB 3 is achieved. As a result, electrical connecting between the IC package 2 and the PCB 3 is established.

In the above preferred embodiment, the protrusions 115 protrude the top surface 111 the height h1, thus the IC package 2 is sustained on the protrusions 115, not directly touching the top surface 111 when the IC package 2 is pressed to mate with the socket connector 1. Further, the height h1 is shorter than said first distance h2 of the upper contact portion 1221 projecting above the top surface 111, and higher than said second distance h3 of the upper end of the bodies 121 with respective to the top surface 111. Thereby, the pad 21 of the IC package 2 just engages the upper contact portion 1221 of corresponding contact 12, having no chance to touch the upper end of the body 121 of an adjacent contact 12. As a result, reliable electrical engagement between the pads of the IC package 2 and corresponding contacts 12 of the socket connector 1 is secured.

Figure 6:
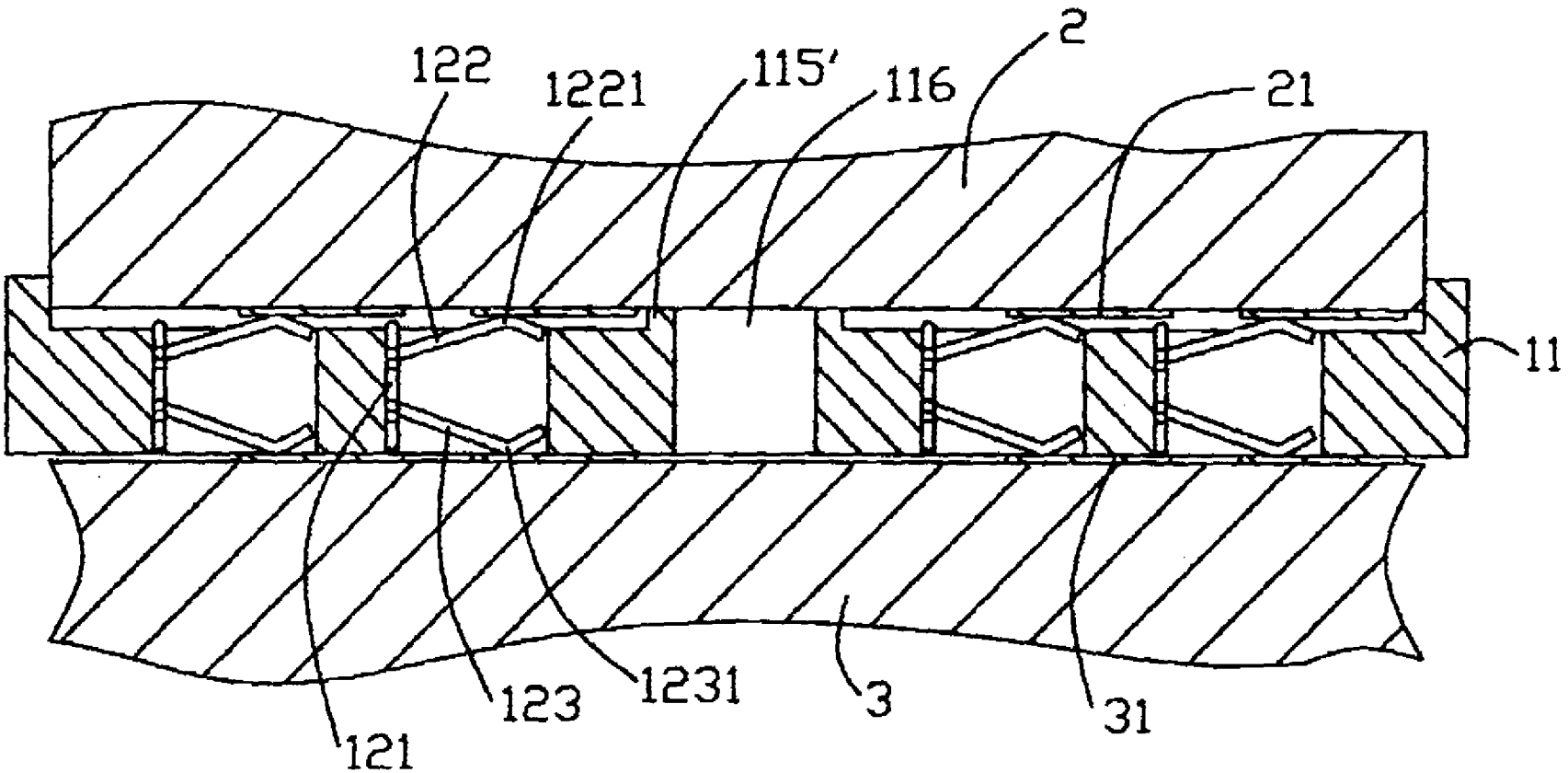
FIG. 6 is a cross sectional view of a socket connector according to a second embodiment of the present invention, together with the IC package and the PCB electrically connecting with the socket connector.
Figure 7:
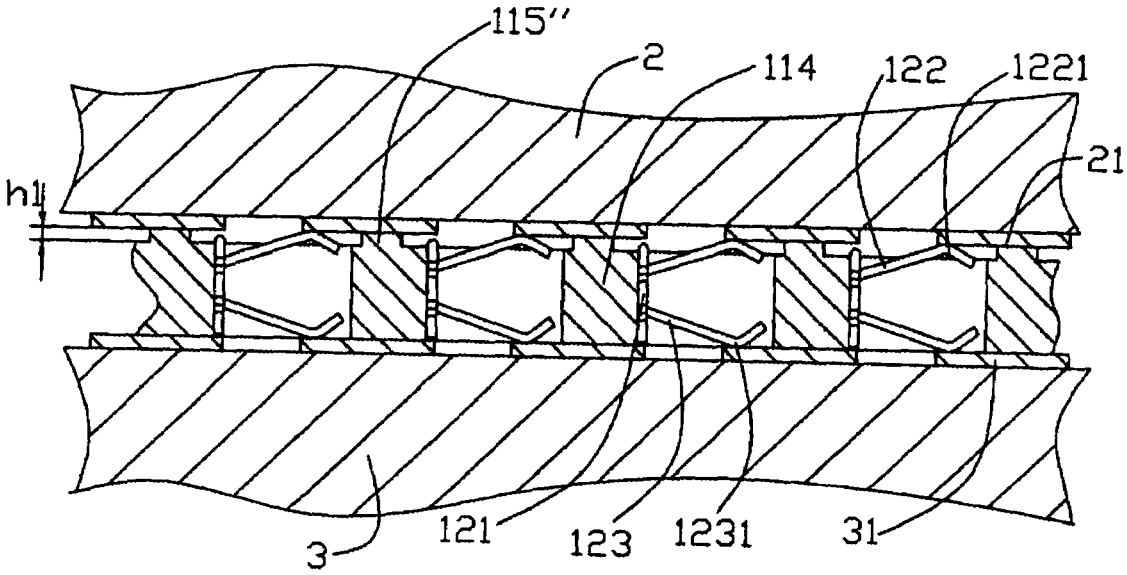
FIG. 7 is a cross sectional view of a socket connector according to a third embodiment of the present invention, together with the IC package and the PCB electrically connecting with the socket connector.
Figure 8:
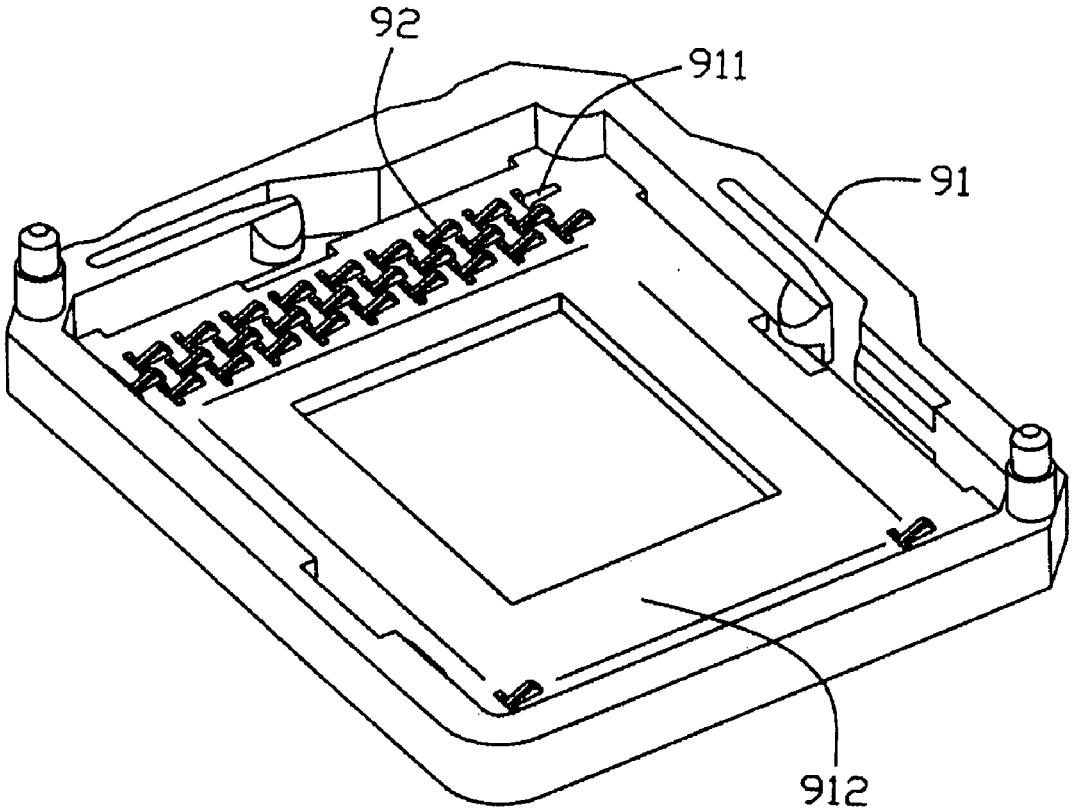
FIG. 8 (PRIOR ART)
FIG. 8 is an isometric view of a typical socket connector, showing terminals received in a housing of the socket connector.
Figure 9:
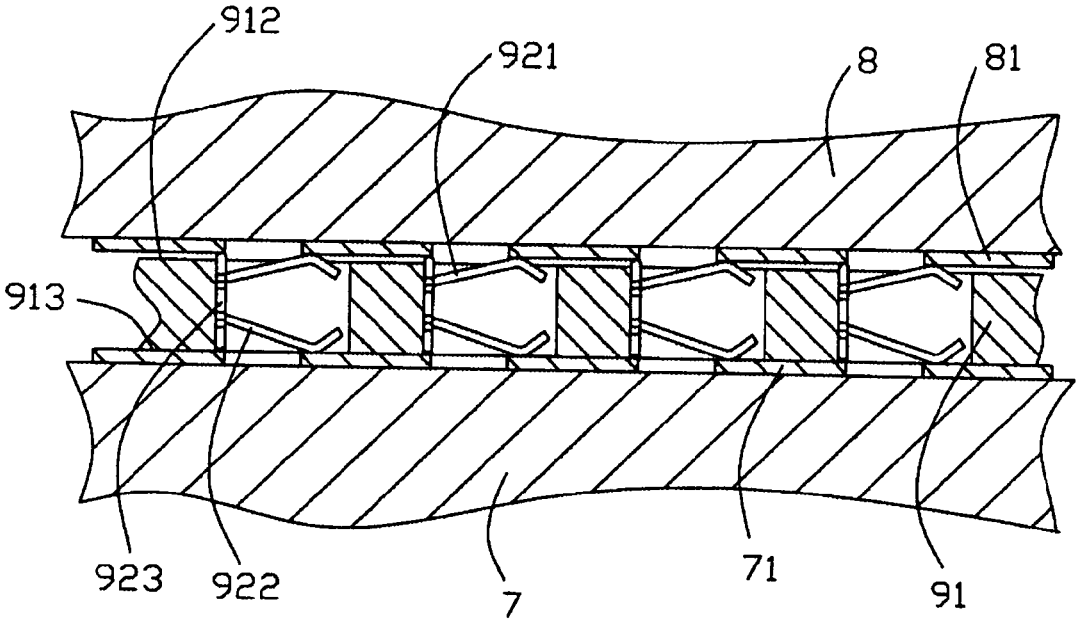
FIG. 9 (PRIOR ART)
FIG. 9 is a cross sectional view of the typical socket connector of FIG. 8, together with an IC package having pads electrical mating with corresponding terminals and a PCB having pads electrically touching with said terminals.

The above-described preferred embodiment shows that the supporting protrusions 115 is placed at periphery of the top surface 111 and adjacent the side walls. It should be understand that the protrusions 115 is not limited thereto, and may be situated at other alternative position of the top surface 111. For one example, referring to FIG. 6, the protrusions 115' are located around the central hole 116 of the housing 11. For another example, referring to FIG. 7, the protrusions 115" are formed on the spacer 114 between every two adjacent passageway 113, respectively. The protrusions 115" is beside a corresponding passageway, at one side of the receiving section 113B of a corresponding passageway 113 and opposing to the securing section 113A of the passageway 113. During insertion the IC package 2 into the housing 11 to electrically engage with the contact 12, the pad 21 of the IC package 2 stand on the protrusions 115" and electrically mate with the upper contact portion 1221 of the contact 12.

While the present invention has been described with reference to particular embodiments, it is not to be construed as being limited thereto. Various equivalent modifications and alterations known to persons skilled in the art can be made to the embodiments without in any way departing from the scope or spirit of the present invention as defined in the appended claims.

What is claimed is:

1. A socket connector for electrically connecting an electrical device having conductive pads arranged thereon, the socket connector comprising:

a dielectric housing defining a mounting surface toward the electrical device and a plurality of passageways extending from said mounting surface;

a plurality of contacts received in the passageways, respectively, the contacts each comprising a retention body secured in a corresponding passageway and an upper spring arm extending from the retention body, the upper spring arm having a contact portion at a top thereof, the contact portion extending beyond the mounting surface a first distance in a thickness direction of the housing for engaging a corresponding pad of the electrical device, the retention body having a part thereof protruding beyond the mounting surface a second distance in a thickness direction of the housing; and a plurality of supporting members formed on the mounting surface and projecting toward the electrical device, the supporting members projecting beyond the mounting surface a vertical height shorter than said first distance, when the electrical device is pressed to electrically engage with the socket connector, the supporting members upholding the electrical device thereon and the height thereof being higher enough than said second distance to prevent the pads of the electrical device from electrically touching the parts of the retention body adjacent contacts.

2. The socket connector as claimed in claim 1, wherein the supporting members integrally extend from periphery of the mounting surface.

3. The socket connector as claimed in claim 1, wherein the housing define a central hole therein, the supporting members extend integrally from the mounting surface, situated around the central hole.

4. The socket connector as claimed in claim 1, wherein the supporting members integrally extend from the mounting surface, situated between every two adjacent passageways, respectively.

5. The socket connector as claimed in claim 4, wherein when the electrical device engages with the socket connector, the conductive pad rests on a corresponding supporting member.

6. The socket connector as claimed in claim 5, wherein the passageways each have a securing section and a receiving section perpendicular to and in communicating with the securing section.

7. The socket connector as claimed in claim 6, wherein the supporting members each are situated at one side of the receiving section of a corresponding passageway, opposing to the securing section of said passageway.

8. The socket connector as claimed in claim 1, wherein the housing defines a matting surface opposite to the mounting surface, the retention body of the contact flush with the mating surface.

9. The socket connector as claimed in claim 8, wherein the contact further comprises a lower spring arm extending beyond the mating surface for engaging an exterior electrical device, the upper and lower spring arms situate in a same side of the retention body.

10. A socket connector for electrically connecting an electrical package and an electrical device, the socket connector comprising:

a dielectric housing defining a top surface toward the electrical package and a plurality of vertical passageways terminated on the top surface;

a plurality of contacts received in the passageways, respectively, the contacts each comprising a retention body, an upper spring arm extending from the retention body and a contact portion formed at the upper spring arm, the contact portion extending a first vertical distance beyond the top surface for engaging a corresponding pad of the electrical package, the retention body projecting a second vertical distance from the passageway outside the top surface; and a plurality of supporting protrusions extending upwardly from periphery of the top surface toward the electrical device, the protrusions projecting beyond the top surface a uniform vertical height smaller than said first distance but longer than said second distance, the protrusions sustaining the electrical package thereon, when the electrical package is pressed to mate with the socket connector.

11. The socket connector as claimed in claim 10, wherein the protrusions are formed unitarily with the housing.

12. The socket connector as claimed in claim 10, wherein the housing defines a bottom surface opposite to the top surface, the retention body of the contact flushing with the bottom surface.

13. The socket connector as claimed in claim 12, wherein the contact further comprises a lower spring arm extending beyond the bottom surface for engaging an exterior electrical device.

14. The socket connector as claimed in claim 13, wherein, the upper and lower spring arms are generally symmetrically orientated with respect to the retention body, and arranged at one side of the retention body.

15. An electrical socket assembly comprising:

an electronic package having a plurality of conductive pads on an undersurface thereof;

an insulative housing defining a plurality of through holes between opposite top and bottom surfaces in a vertical direction, each of said through holes essentially defined by at least four surrounding side faces;

a plurality of contacts disposed in the corresponding through holes, respectively;

each of said contacts including a retention section abutting against a first face of said side faces, a contact portion extending both upwardly toward the top surface and horizontally toward a second face of said side faces opposite to said first face, and up and down moveable in corresponding through hole, a contact tip section of said contact portion being spaced from the top surface with a first distance; and a protrusion structure formed on the top surface with a second distance smaller than the first distance; wherein when the electronic package is loaded unto the housing, the conductive pads are respectively seated upon the corresponding contact tip sections and downwardly press said contact portions with deflection until said electronic package is downwardly engaged with and supported by the protrusion structure.

16. The assembly as claimed in claim 15, wherein the engagement between said electronic package and said protrusion structure occurs on at least one conductive pad of said electronic package.

17. The assembly as claimed in claim 15, wherein the retention section extends upwardly above the top surface with a third distance smaller than both first and second distance.

18. The assembly as claimed in claim 15, wherein said protrusion structure is located on a periphery of said housing.

19. The assembly as claimed in claim 15, wherein each of said through hole defines a cross-section having essentially a long side and a short side thereof, and the protrusion structure is located by the short side.

20. The assembly as claimed in claim 15, wherein each of said through hole defines a cross-section having essentially a long side and a short side thereof, and the protrusion structure is located by the long side.

21. The assembly as claimed in claim 15, wherein said protrusion structure is formed around at least one of said through hole.

22. The assembly as claimed in claim 21, wherein said protrusion structure includes a plurality of dispersing upward embossments mingled a among the through holes.

* * * * *